US010186408B2

(12) United States Patent
Hoehndorf

(10) Patent No.: US 10,186,408 B2
(45) **Date of Patent: *Jan. 22, 2019**

(54) MALDI SUPPORT WITH MAGNETICALLY HELD SPRING STEEL PLATE

(71) Applicant: Bruker Daltonik GmbH, Bremen (DE)

(72) Inventor: Jens Hoehndorf, Bremen (DE)

( * ) Notice: Subject to any disclaimer, the term of this patent is extended or adjusted under 35 U.S.C. 154(b) by 39 days.

This patent is subject to a terminal disclaimer.

(21) Appl. No.: 15/407,527

(22) Filed: Jan. 17, 2017

(65) Prior Publication Data

US 2017/0125227 A1 May 4, 2017

Related U.S. Application Data

(63) Continuation of application No. 14/861,351, filed on Sep. 22, 2015, now Pat. No. 9,564,303.

(30) Foreign Application Priority Data

Oct. 6, 2014 (DE) ..... 10 2014 114 426

(51) Int. Cl.
*H01J 49/04* (2006.01)
*H01J 49/40* (2006.01)

(52) U.S. Cl.
CPC ..... *H01J 49/0418* (2013.01); *H01J 49/0409* (2013.01); *H01J 49/40* (2013.01)

(58) Field of Classification Search
CPC ..... H01J 49/0409; H01J 49/40
USPC ..... 250/288, 440.11, 441.11, 442.11, 443.1
See application file for complete search history.

(56) References Cited

U.S. PATENT DOCUMENTS 9,564,303 B2 * 2/2017 Hoehndorf ..... H01J 49/0418

* cited by examiner

*Primary Examiner* — Nicole Ippolito
(74) *Attorney, Agent, or Firm* — Benoît & Côté Inc.

(57) ABSTRACT

The invention relates to a low-cost spring steel plate as the sample support on a dimensionally stable and precisely shaped substructure, machined from an aluminum alloy, for example, and using a pattern of embedded magnets so that said plate is removable and that a body is created overall which is suitable for use in robots, for example by giving it the dimensions of a conventional microtitration plate. The planarity of the surface onto which the (organic) samples are applied is provided within the near region by the spring steel plate itself and in the far region over the whole spring steel plate by the substructure. The spring steel plate may be designed for single use in order to satisfy IVD diagnostic regulations also, for example. It can be equipped with identification codes, sample site markings and pre-coatings for different types of analytical tasks, such as MALDI-TOF mass spectrometric analysis.

20 Claims, 2 Drawing Sheets

MALDI SUPPORT WITH MAGNETICALLY HELD SPRING STEEL PLATE

BACKGROUND OF THE INVENTION

Field of the Invention

This invention relates to the structure of sample support plates for the analyses of organic samples in time-of-flight mass spectrometers with ionization of the analyte substances by matrix-assisted laser desorption, given that today's requirements in respect of the mass accuracy mean that the surface of the sample support plates must have a high degree of planarity.

Description of the Related Art

Mass spectrometry with ionization by matrix-assisted laser desorption (MALDI) has become established as a standard method for the analysis of biomolecules. Time-of-flight (TOF) mass spectrometers are usually used. They determine the mass of the ions by measuring their time of flight from the surface of the sample support plate to the ion detector.

In order to fulfill today's requirements in respect of the accuracy of the mass determination, the ions from all samples on the sample support plate must pass through flight paths whose lengths are exactly known. If one assumes that the flight path is two meters long, as is usual in commercially available mass spectrometers, this means that a deviation in the flight distance of only one micrometer results in a deviation in the time of flight of half a millionth, and a deviation in the mass calculated therefrom by one part per million (1 ppm). Today's mass determinations aim to achieve deviations of only a few hundred parts per billion, however. This means that the length of the flight path from sample to sample must be known to within one tenth of a micrometer.

Since the sample support plates are usually moved with precise x-y movement stages so that each sample under analysis is in the axis of the trajectory, the planarity of the sample support plates plays a very important role. Deviations from planarity over a wide area or slight tilting of the sample support plates can be taken into account by measuring a pattern of mass reference samples distributed over the plate, since these measurements give a pattern of the precise distances of the reference samples from the ion detector. When calculating the mass from the time of flight, however, it must be possible to do a very accurate interpolation for the analytical samples which lie between the mass reference samples. The sample support plate must therefore have no undulations (or as few as possible).

Modern time-of-flight mass spectrometers use movement stages which can mechanically eliminate any tilting of the sample support plates by measuring mass reference samples. This mechanical correction is equivalent to a linear mathematical interpolation, but a linear interpolation requires planarity of the sample support plate over a wide area without any curvature.

For preparing the samples on the sample support plate, there are methods which produce thin matrix layers with embedded analyte molecules and with a thickness of only around one micrometer, which also offer relatively good reproducibility of the thickness.

From the equivalent documents DE 101 40 499 B4, GB 2 378 755 B and U.S. Pat. No. 6,670,609 B2 (J. Franzen, 2001), composite plates are known which consist of a stainless steel plate around three to four millimeters thick on a substructure produced by injection molding or even made from a plastic material, which is not very precise in terms of shape. The planarity in the near and far region here is provided solely by the stainless steel plate. It has been found, however, that stainless steel plates of this thickness are deformed by machining (cutting and milling) and the resulting internal stresses to such a degree that they do not provide the planarity required today.

The equivalent documents DE 102 30 328 B4, GB 2 391 066 B and U.S. Pat. No. 6,825,465 B2 (M. Schürenberg, 2002) describe how an elastic, electrically conductive, thin plastic plate is fastened on a solid substructure by being clamped around its edge, the planarity being provided almost solely by the substructure. This cannot fulfill today's requirements in respect of planarity either.

The document WO 2005/037434 A1 (McCarthy et al., "MALDI Plate with Removable Magnetic Insert") explains how a sample support plate having at least one magnetic part is held in a frame by a magnet. The planarity here must be provided solely by the sample support plate. The document U.S. Pat. No. 7,619,215 B2 (Kim et al., "Sample Plate for MALDI Mass Spectrometry and Process for Manufacture of the Same") likewise shows magnetic fixation of a sample plate on a flat frame by means of a multitude of magnets.

In view of the foregoing, there is still a need for sample supports which offer the requisite planarity, can be produced at low cost and fulfill other requirements, if possible, for example the single-use requirement for IVD methods and the possibility to use them in pipetting robots.

SUMMARY OF THE INVENTION

The invention proposes fastening a spring steel plate, which can be produced at low cost and is only around 0.1 to 0.8 millimeters thick, on a very dimensionally precise substructure by means of a pattern of magnets embedded in the substructure in such a way that the plate is removable. Experience shows that the spring steel plates are extremely planar (albeit they can be almost imperceptibly curved). The substructure can be manufactured from an aluminum alloy, for example, which can be machined very precisely without any stress and in which the magnets are embedded. The aim here is to produce a body shape from substructure and spring steel plate which is suitable for introduction into the ion source and for use in pipetting robots, or other robots, by having the standardized dimensions of a commercial microtitration plate, for example.

If manufactured appropriately, the elastic spring steel plate has a reflecting, very planar surface without any undulations, although overall it can be almost imperceptibly curved. Spherical forms of curvature can be excluded here; only cylindrical forms of curvature occur in practice. This cylindrical curvature is eliminated completely by the pattern of distributed magnets, which pull the plate powerfully onto suitably precise supporting surfaces of the substructure. The planarity of the surface for the samples is then provided by the spring steel plate within the near region, and by the substructure in the far region over the whole spring steel plate. It is evident that the smoothing of a cylindrical curvature cannot be achieved with a single magnet, as is suggested by prior art document WO 2005/037434 A1.

The spring steel plates can be manufactured from large spring steel sheets, for example rolled sheets, by very gentle cutting methods, such as water jet cutting or, in particular, by cutting with picosecond lasers. They can be produced in large quantities, with very high precision, with practically no burr, no stress, and at low cost. They require very little mechanical finishing.

The spring steel plates may be designed for single use in order to satisfy IVD diagnostic regulations also. They can be designed with identification codes, sample site markings and pre-coatings for different types of analytical tasks.

DETAILED DESCRIPTION

While the invention has been shown and described with reference to a number of embodiments thereof, it will be recognized by those skilled in the art that various changes in form and detail may be made herein without departing from the scope of the invention as defined by the appended claims.

As set out before, the invention consists basically in using embedded magnets to hold a very planar, thin, elastic and low-cost spring steel plate as the sample support on a precisely shaped and dimensionally stable substructure, which is machined from an aluminum alloy, for example, in such a way that a composite sample support is created, which can be introduced into the ion source, but is also suitable for use in robots to prepare samples, for example by giving it the dimensions of a commercially available microtitration plate. The planarity of the surface onto which the samples are applied is provided within the near region by the spring steel plate itself, and in the far region it is provided over the whole spring steel plate by the substructure. The spring steel plate may be designed for single use in order to also satisfy IVD diagnostic regulations. It can be equipped with identification codes, sample site markings and pre-coatings for different types of analytical tasks.

Figure 1:
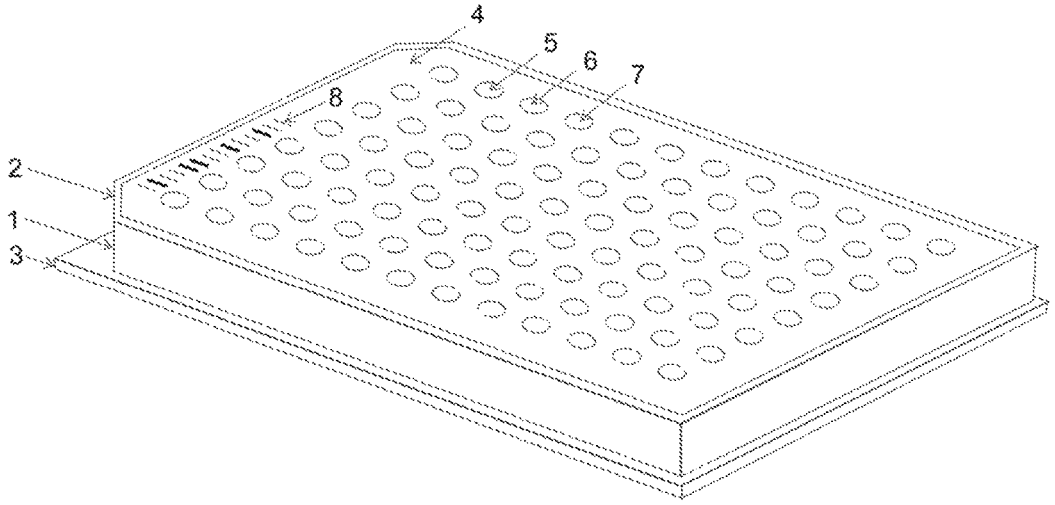
FIG. 1 shows the overall structure, with substructure (1), its bottom edge (3) and the framing top edge (2), in which the spring steel plate (4) is embedded and magnetically held. The spring steel plate (4) holds the sample sites (5, 6, 7) with enclosing rings and barcode labeling (8).
Figure 2:
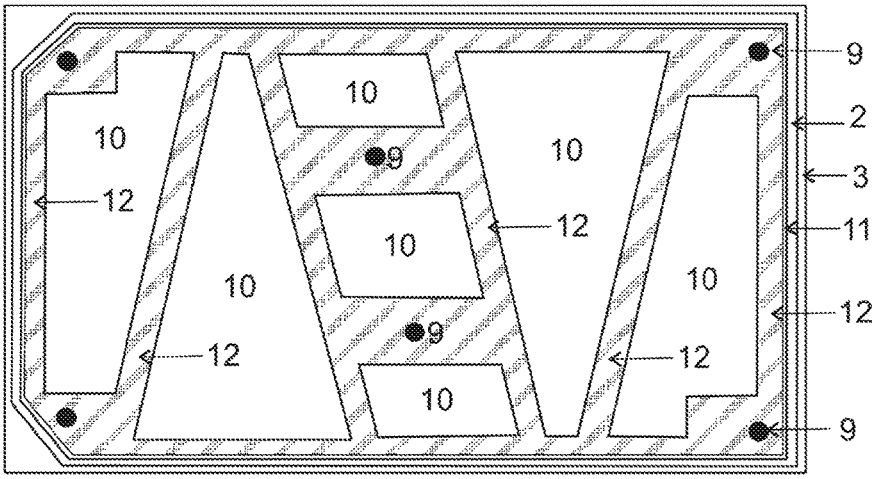
FIG. 2 shows, by way of example, a plan view of a substructure with the spring steel plate removed, with bottom edge (3), top edge (2) for embedding the steel plate, precise supporting surfaces (12) for the steel plate, channel (11) to accommodate any possible burr, magnets (9) and weight-reducing cutouts (10).

As shown in FIG. 1 by way of example, the invention proposes an arrangement in which a very planar, highly elastic and low-cost spring steel plate (4) with a thickness of only around 0.1 to 0.8 millimeters, preferably 0.2 to 0.5 millimeters, is fastened on a very dimensionally precise and stable substructure (2) using a pattern of embedded magnets, allowing the plate to be removed. The magnets pull the spring steel plate onto a precisely planar supporting surface and eliminate any curvature of the spring steel plate which may be present. FIG. 2 is a plan view of the substructure with an example pattern of the magnets (9) and the precisely shaped supporting surface (12). At the edges, the spring steel plate (4) is embedded into a frame (2) of the substructure. It can be advantageous for the spring steel plate (4) to be pretensioned very slightly in a concave or convex curvature. A milled-out channel (11) at the inner edges of the frame (4) can ensure that any burr which may be present does not produce any detrimental curvature.

The substructure can be manufactured from an aluminum-magnesium alloy, such as AW-5083 [Al Mg4.5 Mn0.7], which can be machined very precisely without any stress, and in which the magnets (9) are embedded. Commercial, neodymium-iron-boron disk-shaped permanent magnets, 5 mm in diameter and 3 mm thick, can be used, for example. In order to save weight, the interior of the substructure can be largely milled out, leaving a strength-conserving grid structure. This also allows the spring steel plate to be pressed out of the substructure from below through one of the milled-out openings (10). The aim is to produce a composite form, comprising the substructure and the steel plate, which is suitable for use in pipetting robots, and other robots for sample preparation, for example by giving it the dimensions of a commercial microtitration plate (96-well plate). FIG. 1 shows, by way of example, such a composite structure in the form of a microtitration plate, FIG. 2 an associated substructure which is largely milled out to save weight. The robots for the sample preparation are often unable to handle very heavy support plates, so a lightweight design is advantageous. According to the ANSI standard (American National Standards Institute), a microtitration plate has the dimensions 127.76 mm×85.48 mm×14.35 mm.

The substructure can also consist of other metallic or nonmetallic materials, as long as the material provides the required dimensional stability. It can consist of carbon fiber reinforced plastic, for example, which allows the plates to be manufactured with very precise shape.

MALDI mass spectrometers are available commercially with ion sources that can accept sample support plates in the form of microtitration plates. Composite sample supports in the form of a microtitration plate also allow the sample supports to be stacked together without coming into contact with the samples. The thin spring steel plates for this form of composite sample support measure around 80 mm×120 mm. A suitable material for the spring steel plates is the stainless, yet magnetic, chromium steel 1.4016 in accordance with EN 10088-2, for example. Other magnetic spring steels are also suitable and can be selected according to the requirements of the analytical application.

The underside of the inserted spring steel plates (4) lies on precisely shaped supporting surfaces (12) of the supporting substructure. The planarity described is required on the upper surface, however. The planarity of the surface in the far region could therefore be adversely affected by variations in the material thickness of the steel plates. If the spring steel plates are cut from large, machine-rolled, semi-finished products, however, the variation in the thickness across a steel plate is very small. In actual practice, thickness variations are negligible when suitable production methods are used for the semi-finished products.

Different batches of the semi-finished product can quite easily differ from each other even though they have the same nominal thickness. This change can easily be controlled by measuring and compensating the sample separation once per sample support. This can be done mechanically, electrically, or preferably by measuring mass reference substances in the mass spectrometer.

Modern mass spectrometers can be equipped with devices which not only move the sample support plate in both spatial directions perpendicular to the beam formation, but also align it by tilting with feedback by measurements of mass reference substances so that the ion paths from the surface of the support plate to the ion detector are all exactly the same, with errors of only a few tenths of a micrometer. This method is mathematically equivalent to a linear interpolation of the distance from a tilted support plate, but likewise requires a very planar surface for the application of the samples with no curvature or undulations.

In ion sources of other mass spectrometers, sample supports may be used with other dimensions, for example, sample supports with only a quarter of the size of a microtitration plate. Here too, appropriate substructures with magnetically held steel plates can be used in order to manufacture composite sample supports of a suitable size. The steel plates are then correspondingly smaller for smaller sample supports and can also be thinner, for example with a thickness of 0.1 to 0.3 millimeters.

Figure 3:
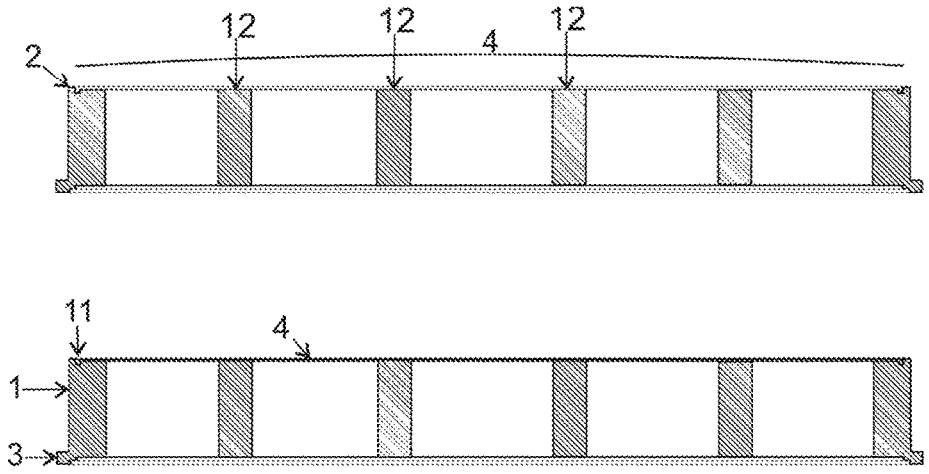
FIG. 3 depicts a cross-section through the substructure. The top part shows an exaggeratedly curved spring steel plate (4) above the substructure. In the lower part of the diagram, this plate is pulled onto the supporting surface (12) of the substructure by the magnets (not visible in the cross section) so that the curvature is no longer present.

Highly elastic spring steel sheets with a very flat surface are commercially available. Spring steel plates manufactured from these sheets can have an overall curvature on the micrometer scale, however, which is scarcely recognizable to the naked eye. Experience shows that no spherical forms of bending with curvatures in two spatial directions occur here; in practice, only cylindrical forms of bending occur with curvatures in one spatial direction; when suitable cutting methods are used, no undulations occur either. The slight cylindrical curvature is eliminated completely by the magnets, which pull the plate firmly onto supporting surfaces (12) of the substructure manufactured with the requisite precision, as is depicted in FIG. 3 with the aid of a spring steel plate with a curvature (4) that is exaggerated here in order to illustrate the point. As shown in FIGS. 2 and 3, instead of using the whole area of the substructure as the supporting surface (12), the present disclosure is directed to supporting surfaces which stand proud of the surrounding area, such as resulting from milling out an integral plate. Within the near region of the samples, which extends at least to the next, the next but one, or the next but two neighboring sample, the planarity of the surface on the spring steel plate for the samples is provided by the spring steel plate (4) itself, and in the far region it is provided across the whole plate by the precision of the supporting surfaces (12) of the substructure.

For the mass spectrometric analysis, it is advantageous for the spring steel plates to be electrically conductive and thus able to generate homogeneous electric fields to accelerate the ions.

The spring steel plates can be manufactured from large rolled sheets by very gentle cutting methods, such as water jet cutting or, in particular, by cutting with picosecond UV lasers, in large quantities, with very high precision, with practically no burr, no stress, and at low cost. Cutting the spring steel plates with picosecond lasers does not cause them to heat up, and so does not produce any edge rippling, which is particularly detrimental, since it is not possible to compensate for such rippling. The spring steel plates thus produced require practically no mechanical finishing. In order to also preclude the detrimental effects of a residual formation of burr, a channel (11) can be milled into the edge of the substructure, into which any remaining burr can protrude.

Figure 4:
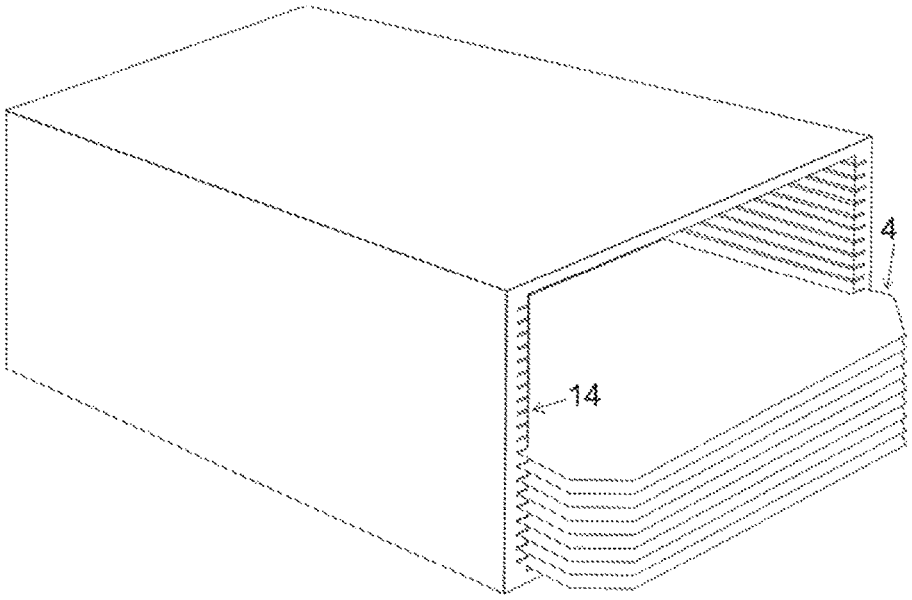
FIG. 4 shows a storage box (without its lid) with insertion slots (14) and some inserted spring steel plates (4).

The spring steel plates are ideal for single use, in order to also satisfy IVD diagnostic regulations or to counteract any substance carry-over ("memory"), while the substructures can be reused many times. Any residues from the manufacturing processes of the spring steel plates, such as separating agents or lubricants, can be removed by conventional methods until the required level of cleanliness is achieved for the analytical task in hand. The spring steel plates thus cleaned can be shipped in slide-in boxes with lateral guides and also stored in the boxes after use, complete with samples to be used for subsequent controls. FIG. 4 shows a shipping and storage box without its lid, but with several spring steel plates (4) inserted. The boxes have lateral guides (14), and can be provided with a desiccant. A box with twenty spring steel plates, each 0.5 millimeters thick, for a substructure in the form of a microtitration plate weighs around one kilogram; if spring steel plates with a thickness of only 0.3 millimeters are used, the box weighs around half a kilogram. A box for twenty spring steel plates has dimensions of around 50 mm×90 mm×130 mm.

For noncritical analytical methods, the spring steel plates can also be used several times, however, since they can be cleaned well.

The cleaned spring steel plates can be supplied without any surface treatment whatsoever, as they can be seen in the box in FIG. 4; sample preparation robots can determine the sample sites on these spring steel plates, for example, and also apply labeling. The spring steel plates can also be supplied with identification numbers or letters, one-dimensional or two-dimensional barcodes, markings for sample sites, and pre-coatings for different types of analytical tasks, as is shown in FIG. 1.

For the reproducibility of the planarity it can be advantageous to deliberately pre-curve the spring steel plates slightly, so that they can be placed with their concave side in contact with the substructure, and the samples are deposited on the convex side, for example, as is shown in FIG. 3. The markings should then always be applied to the convex side.

Visible rings can also be applied to mark the sample sites, for example. The rings can simply be printed on, etched on, or inscribed with a laser. As these rings are being produced, it is also possible to apply identification numbers and one-dimensional or two-dimensional barcode markings. In addition to the arrangement of 96 rings with 9.0 millimeter spacing, rings three millimeters in diameter with 4.5 millimeter spacing are favorable, for example; this results in 384 sample sites. For robot-controlled coating, in particular, it is also possible to use 1536 rings with a diameter of 1.5 millimeters and a spacing of 2.25 millimeters.

If the rings are printed, for example by non-contact inkjet printers, special attention must be paid to the ink used. The ink must be selected so that none of its constituents leak out over months and years and creep over the surface of the sample sites. The rings can preferably consist of a material which cannot be wetted by the sample liquid so that the rings serve as a barrier to prevent the samples applied in liquid form from spreading out. Instead of using rings, it is also possible to print a non-wettable material onto the entire surface between the sample sites. The use of hydrophilic-hydrophobic surface structures is known from the equivalent patents DE 197 54 987 C2, GB 2 332 273 B and U.S. Pat. No. 6,287,872 B1 (M. Schürenberg et al.).

The sample sites can also be pre-coated with matrix material in a way which is known as such. It is preferable if thin layers of the matrix material of uniform thickness are applied. It is known, for example, that the matrix substance CHCA (α-cyano-4-hydroxycinnamic acid) crystallizes out in a very fine and dense manner on a metal substrate, with crystal sizes of around one micrometer if the surface has been provided with tiny, extremely fine graphite particles (cf. J. Gorka et al.: "Graphite supported preparation of alpha-Cyano-4-Hydroxycinnamic Acid (CHCA) for matrix-assisted laser desorption/Ionization mass spectrometry", J Am Soc Mass Spectr 23: 1949-1954). Very fine thin layers can also be applied by resublimation of the matrix substance, for example by using templates in order to coat only the sample sites. The application of thin layers by non-contact bombardment with droplets is known also, according to a principle used by inkjet printers.

The sample sites can also be simply coated with nuclei which assist the matrix material to crystallize out in a thin layer. The sample sites can be coated with graphite particles, for example, which can be applied by rubbing with a felt, and which adhere firmly. CHCA then crystallizes out from a sample solution in a thin layer at these sample sites and thus incorporates the analyte molecules into the crystal structure. Other crystallization nuclei can be used for other matrix materials.

Once the sample sites on the spring steel plates have been coated with thin layers of pure matrix material, the sample liquids can, for example, be applied, after suitable preparation, with light pressure directly from special microtitration plates located above. These plates are equipped with porous filter bottoms and with wells in which the samples were prepared. After a short time, the analyte molecules adhere firmly to the surface of the microcrystals, and the solution can then be removed by pipetting or absorbed by filter paper. After drying, a small amount of solvent can be applied to the samples in a way known as such in order to incorporate the analyte molecules into the crystals by recrystallization.

The spring steel plates according to the invention can also be used for high-throughput characterization of reactions on amino acid chains by mass spectrometry, as is explained in document DE 10 2013 006 132 A1 (equivalent to GB 2 517 004 A and US 2014/0306104 A1). For this purpose, the plates need to be gold-plated. Nowadays, it is technically possible to bind sulfurous compounds such as thiols, thioether and others onto gold-plated surfaces by means of a sulfur/gold interaction so as to form monomolecular layers of molecules in a self-structuring way. These molecules can have reaction centers to which further molecules can be covalently bonded by photochemical means, using targeted laser irradiation of defined small areas. If the covalently bonded molecules are in a suitable configuration, it is possible to again covalently bond any other molecules to these molecules by photochemical means. It is thus possible to produce sample arrays which contain 960,000 small sample areas, each measuring 100×100 square micrometers and each coated with different peptides of the same length of twenty amino acids, for example, on a spring steel plate. The peptides can, for example, be all the peptide chains of corresponding length from the human proteome, and can also have overlapping sequences. The peptides can, for example, be specifically made to react with reactants such as enzymes or chemicals (modification array), or ligands can be made to bind to them (interaction array) in order to determine which reactants react with which peptide sequences at which positions, or which ligands bind to which peptide chains.

A little additional effort is all that is required to extend the invention to nonmagnetic spring steel plates. In this case, a magnetic material must be applied to the back of the sample support in the region of the magnets in order to produce an attractive force. Small iron platelets fixed in place with adhesive are suitable, for example. If the sample support has the properties of planarity within the near region and the requisite elasticity, the functional principle described can also be applied.

The composite support plates with embedded spring steel plates for this invention provide a starting point for a number of analytical applications which cannot all be described here in detail, but are to be included in the protection for the invention. The invention has been described with reference to a number of different embodiments thereof. It will be understood, however, that various aspects or details of the invention may be changed, or various aspects or details of different embodiments may be arbitrarily combined, if practicable, without departing from the scope of the invention. Generally, the foregoing description is for the purpose of illustration only, and not for the purpose of limiting the invention which is defined solely by the appended claims.

The invention claimed is:

1. A composite sample support plate for mass spectrometric analysis of samples, said plate having a dimensionally stable and precisely shaped substructure, on which a spring steel plate is magnetically fixable, while the surface of the spring steel plate that faces away from the substructure receives the samples, the spring steel plate being substantially less than three millimeters thick and a plurality of magnets being distributed over the substructure and pulling the spring steel plate against the substructure in such a way that any curvature of the spring steel plate is smoothed out, wherein the plurality of magnets is embedded in a plurality of supporting surfaces which stand proud of the surrounding substructure areas.

2. The composite sample support plate according to claim 1, wherein the spring steel plate is slightly pre-curved.

3. The composite sample support plate according to claim 2, wherein the concave side of the slightly pre-curved spring steel plate is laid on the substructure, and the convex side receives the samples.

4. The composite sample support plate according to claim 1, wherein the substructure has one magnet near each corner and at least one near the center of the spring steel plate.

5. The composite sample support plate according to claim 1, wherein the spring steel plate is equipped with identity markings in the form of at least one of letters, numbers and barcodes.

6. The composite sample support plate according to claim 1, wherein the spring steel plate is equipped with visible rings to mark the sample sites.

7. The composite sample support plate according to claim 6, wherein the rings are printed onto the spring steel plate.

8. The composite sample support plate according to claim 7, wherein the printed rings consist of a material which cannot be wetted by the sample liquid to be used.

9. The composite sample support plate according to claim 7, wherein the areas outside the sample sites on the spring steel plate are coated with a material which cannot be wetted by the sample liquid to be used.

10. The composite sample support plate according to claim 6, wherein the sample sites on the spring steel plate are coated with layers of a matrix material for ionization by matrix-assisted laser desorption.

11. The composite sample support plate according to claim 6, wherein the sample sites on the spring steel plate are coated with crystallization nuclei so that a matrix material for ionization by matrix-assisted laser desorption can crystallize out.

12. The composite sample support plate according to claim 11, wherein particles of graphite are used on the spring steel plate as crystallization nuclei for the matrix material α-cyano-4-hydroxycinnamic acid for ionization by matrix-assisted laser desorption.

13. The composite sample support plate according to claim 1, wherein the plurality of magnets is arranged one of flush with and sunk into the supporting surfaces.

14. The composite sample support plate according to claim 1, wherein the substructure is made from one of metallic and nonmetallic materials.

15. The composite sample support plate according to claim 14, wherein the substructure is made from an aluminum alloy.

16. The composite sample support plate according to claim 15, wherein the aluminum alloy is AW-5083 [Al Mg4.5 Mn0.7].

17. The composite sample support plate according to claim 14, wherein the substructure is made from carbon fiber-reinforced plastic.

18. The composite sample support plate according to claim 1, wherein the substructure comprises a frame into which the spring steel plate is embedded at its edges.

19. The composite sample support plate according to claim 1, wherein the plurality of magnets comprises disk-shaped permanent magnets.

20. The composite sample support plate according to claim 1, wherein the substructure comprises milled-out portions to save weight.

* * * * *